US006494196B2

(12) United States Patent
Harwath et al.

(10) Patent No.: US 6,494,196 B2
(45) Date of Patent: Dec. 17, 2002

(54) ARCHERY BOW STABILIZER HAVING ENERGY DIRECTORS

(75) Inventors: Frank A. Harwath, Downers Grove, IL (US); Robert S. Mizek, Downers Grove, IL (US)

(73) Assignee: New Archery Products Corp., Forest Park, IL (US)

( * ) Notice: Subject to any disclaimer, the term of this patent is extended or adjusted under 35 U.S.C. 154(b) by 0 days.

(21) Appl. No.: 09/760,872

(22) Filed: Jan. 16, 2001

(65) Prior Publication Data

US 2001/0025636 A1 Oct. 4, 2001

Related U.S. Application Data

(63) Continuation-in-part of application No. 09/461,823, filed on Dec. 15, 1999, now Pat. No. 6,186,135.

(51) Int. Cl.[7] ..... F41B 5/20
(52) U.S. Cl. ..... 124/89
(58) Field of Search ..... 124/89

(56) References Cited

U.S. PATENT DOCUMENTS

| | | | | |
|---|---|---|---|---|
| 4,287,868 A | | 9/1981 | Schiff | |
| 4,569,325 A | | 2/1986 | Christian | |
| 4,570,608 A | | 2/1986 | Masterfield | 124/89 |
| 4,579,101 A | | 4/1986 | Batemann, III | |
| 4,803,971 A | | 2/1989 | Fletcher | |
| 4,893,606 A | * | 1/1990 | Sisko | 124/89 |
| 4,953,521 A | | 9/1990 | Troncoso et al. | 124/24.1 |
| 4,982,719 A | * | 1/1991 | Haggard et al. | 124/89 |
| 4,986,018 A | * | 1/1991 | McDonald | 124/89 X |
| 5,016,602 A | | 5/1991 | Mizek | 124/89 |
| 5,339,793 A | * | 8/1994 | Findley | 124/89 |
| 5,511,533 A | | 4/1996 | Waller | 124/89 |
| 5,584,282 A | | 12/1996 | McDonald, Jr. | 124/89 |
| 5,735,257 A | | 4/1998 | Walk | 124/89 |

* cited by examiner

*Primary Examiner*—John A. Ricci
(74) *Attorney, Agent, or Firm*—Pauley Petersen Kinne & Erickson

(57) ABSTRACT

A bow stabilizer for an archery bow having a hollow body with at least one opening and forming a chamber. A plug is removably mounted within at least one opening. An element, which extends from the plug, has a fixed end portion contacting the plug and a free end portion positioned at a distance from the plug. At least a portion of the element is exposed within the chamber and at least a portion of the element converges in a direction from the fixed end portion to the free end portion. The elements provide a decrease in a vibration amplitude during a recoil cycle after an archery arrow is released from the archery bow.

28 Claims, 7 Drawing Sheets

ARCHERY BOW STABILIZER HAVING ENERGY DIRECTORS

CROSS REFERENCE TO RELATED APPLICATION

This application is a continuation-in-part application of U.S. patent application Ser. No. 09/461,823 filed Dec. 15, 1999 now U.S. Pat. No. 6,186,135.

BACKGROUND OF THE INVENTION

1. Field of the Invention

This invention relates to a shock absorbing bow stabilizer that is mounted to an archery bow, for one reason to reduce recoil, shock, vibration and noise when an arrow is shot from the archery bow. More specifically, this invention relates to a shock absorbing bow stabilizer having at least one element, for example an energy director, at least a portion of which is disposed within a chamber of the bow stabilizer to deflect the movement of fill particles in a radially outward direction to decrease the vibration amplitude during a recoil cycle.

2. Description of Related Art

Various bow stabilizers and vibration dampeners have been developed to absorb shock when an arrow is shot from an archery bow. These conventional bow stabilizers generally have a hollow cylinder filled either with a viscous fluid or solid particles to attenuate vibration when an archery arrow is released from an archery bow. For example, one conventional bow stabilizer has a hollow body that defines a sealed chamber that is partially filled with granular solids. The bow stabilizer is mounted to the archery bow and has a counterweight that is fixedly adjustable along a longitudinal axis of the elongated hollow body. The hollow body has two end plugs, each end plug having a connecting portion connected to a plug portion. The connecting portion has a peripheral knurled surface to secure the end plug to the hollow body of the bow stabilizer. The end plugs are typically press fitted to the hollow body to contain the granular solids within the hollow body.

After the archery arrow is released from the archery bow, the archery bow recoils in a cyclic fashion. During a first recoil, the granular solid particles move in a direction towards a first end portion of the chamber and collide with an interior surface of the end plug which seals the opening at the first end portion. During an opposite second recoil, the granular solid particles move in a direction toward a second end portion of the chamber and collide with an interior surface of the end plug which seals the opening at the proximal end portion. This cycle of recoils continues for several milliseconds before the archery bow comes to rest. Because the interior surfaces of the end plugs can be generally flat, a relatively large number of particles collide with the interior surfaces during the recoil cycle. The impact of the particles with the interior surfaces of the bow stabilizer contributes to a recoil vibration having an increased amplitude.

Accordingly, there is an apparent need for a bow stabilizer which experiences a decreased vibration amplitude during the recoil cycle after an archery arrow has been released from the archery bow.

It is also apparent that there is a need for an element, for example an energy director, positionable within a chamber of the bow stabilizer to direct particles in a generally outward radial direction, thereby decreasing the number of particles which collide with the interior surfaces of the end plugs during the recoil cycle.

SUMMARY OF THE INVENTION

It is an object of this invention to provide an insert for deforming a resilient plug and thereby enlarging an outer surface of the removably mounted resilient plug, to sealably close an opening in a hollow body of the bow stabilizer.

It is another object of this invention to provide a bow stabilizer having a decreased vibration amplitude during a recoil cycle after an archery arrow is released from the archery bow.

It is another object of this invention to provide at least one element, for example an energy director, at least partially exposed within a chamber, having an outer surface which deflects the movement of fill particles in a generally outward radial direction towards an internal surface of a hollow body forming the chamber.

The above and other objects of this invention are accomplished with a bow stabilizer for an archery bow having a hollow body, preferably constructed of a suitable, lightweight, rigid material which resists corrosion and deterioration.

At least a portion of the hollow body forms a chamber at least partially filled with a solid and/or a liquid. In one preferred embodiment of this invention, a first plug is removably mounted within an opening at a proximal end portion of the hollow body and a second plug is removably mounted within an opening at a distal end portion of the hollow body to close each opening and sealably contain the fill within the chamber. Preferably, but not necessarily, the second plug is the same as or similar to the first plug. In one preferred embodiment, each plug is made of a resiliently deformable material that is deformed when a compression force is applied to at least a portion of the plug but preferably returns to its initial shape when the compression force is removed.

The first plug and the second plug each forms a bore which is coaxially aligned with a longitudinal chamber axis. At least a portion of each plug has an outer surface having a peripheral shape that corresponds to the shape of the internal surface of the hollow body, thereby forming a tight seal between the plug and the hollow body.

In one preferred embodiment of this invention, an insert is positionable within the bore formed by each of the first plug and the second plug, using conventional means, for example press-fitting the insert within the bore. Preferably, the insert is made of a metal or metal alloy, such as steel or brass. The insert has a shaft which extends through the bore when the insert is positioned within the plug. Preferably, the shaft has a plurality of ribs or projections which extend radially from a periphery of the shaft. The projections ensure that the insert is securely positioned within the bore and that the inner portion of each plug is enlarged so that the outer surface contacts the internal surface of the hollow body to tightly seal and contain the fill within the chamber.

The shaft which is positionable within the first plug preferably forms a second bore having a plurality of internal threads about an interior surface of the shaft forming the second bore for threaded engagement with a first end portion of a mounting stud. A second end portion of the mounting stud is threadedly engageable with a threaded female coupling of the archery bow to secure the bow stabilizer to the archery bow.

The insert which is positionable within the second plug preferably has a flange about a periphery of the insert to radially interfere with at least a portion of an exterior surface of the second plug. The first plug and the second plug are easily removable from the corresponding opening by removing the respective insert.

In one preferred embodiment of this invention, an element, for example an energy director, extends from the first plug and at least a portion of the element is exposed within the chamber. The element has a longitudinal element axis which is preferably coaxially aligned with the longitudinal chamber axis and is made of a resiliently deformable material, for example a natural or synthetic rubber, another polymeric material or a composite material. The element has a fixed end portion contacting or abutting an inner wall or surface of the first plug and a free end portion at a distance from the first plug. The fixed end portion has a distal wall or surface which radially interferes with at least a portion of the inner surface of the first plug. The element is attached or connected to the shaft of the insert positioned within the first plug.

At least a portion of the element preferably converges in a direction from the fixed end portion to the free end portion, along the longitudinal chamber axis. Preferably but not necessarily, the element has an outer surface having a generally conical shape.

Similarly, a second element extends from the second plug and at least a portion of the second element is exposed within the chamber. The second element has a longitudinal element axis which is aligned with the longitudinal chamber axis. Preferably, the second element is made of a resiliently deformable material, the same or similar to the material used to make the first element. The second element has a fixed end portion contacting or abutting an inner wall or surface of the second plug and a free end portion at a distance from the second plug. The fixed end portion has a distal wall or surface which radially interferes with at least a portion of the inner surface of the second plug. The second element may be attached or connected to the shaft of the insert positioned within the second plug.

At least a portion of the second element preferably converges in a direction from the fixed end portion to the free end portion, along the longitudinal chamber axis. Preferably but not necessarily, the second element has an outer surface having a general conical shape suitable for altering or deflecting the direction of particle movement within the chamber.

In accordance with this invention, the bow stabilizer having at least one element at least partially exposed within the chamber, decreases the amplitude of the recoil vibration after release of an archery arrow. During a recoil cycle, the fill particles impact the element and the direction of the relative movement of at least a portion of the fill particles is altered or deflected in a generally radial direction, i.e. towards the internal surface of the hollow body. As a result of this deflection in direction of movement, more particle-particle collisions occur. These particle-particle or intraparticle collisions disrupt the movement of the fill generally toward the inner surface of the first plug and/or the inner surface of the second plug. As a result, the vibration amplitude during the recoil cycle is decreased.

BRIEF DESCRIPTION OF THE DRAWINGS

The drawings show different features of a bow stabilizer, according to preferred embodiments of this invention, wherein.

DETAILED DESCRIPTION OF PREFERRED EMBODIMENTS

Figure 1:
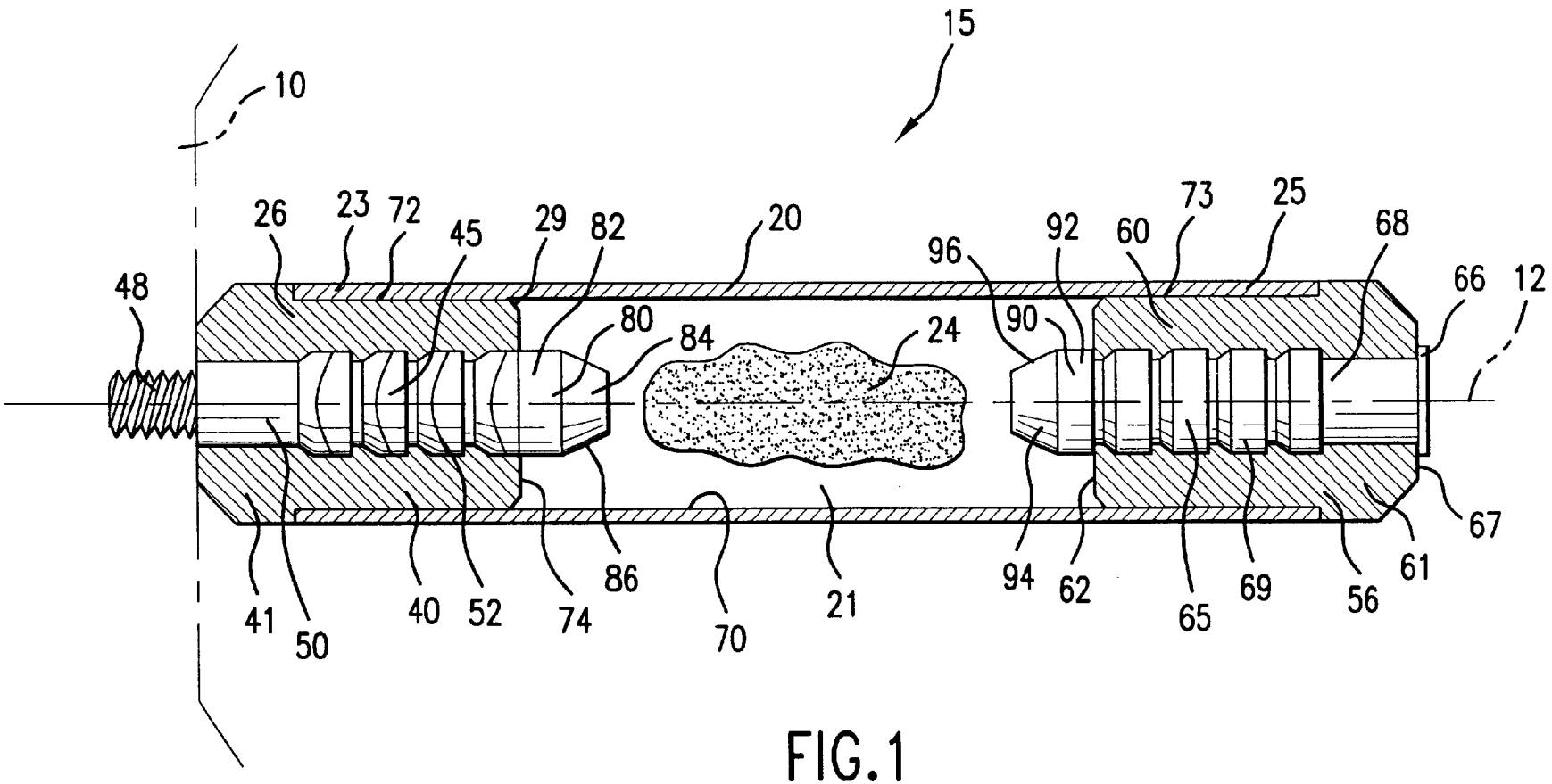
FIG. 1 is a cross-sectional side view, taken through a longitudinal axis, of a bow stabilizer, according to one preferred embodiment of this invention.

Referring to FIG. 1, a bow stabilizer 15 for an archery bow 10 comprises a hollow body 20. Preferably, hollow body 20 is constructed of a lightweight, rigid material. For example, hollow body 20 may be constructed of metal, metal alloy, plastic, fiberglass, any suitable composite and the like. Preferably, the material selected for hollow body 20 is one which resists corrosion and deterioration. A bow stabilizer is disclosed in U.S. Pat. No. 5,016,602, the entire disclosure of which is incorporated in this specification by reference.

Preferably, hollow body 20 is tubular. Hollow body 20 preferably but not necessarily has a generally circular internal cross section. Hollow body 20 may have any other suitable shape. For example, hollow body 20 may have an overall tapered shape or hollow body 20 may be necked down in a midregion. Further, hollow body 20 may have other suitable non-circular internal cross-sectional shapes, such as a triangular shape, a rectangular shape or any other non-circular shape.

Figure 2A:
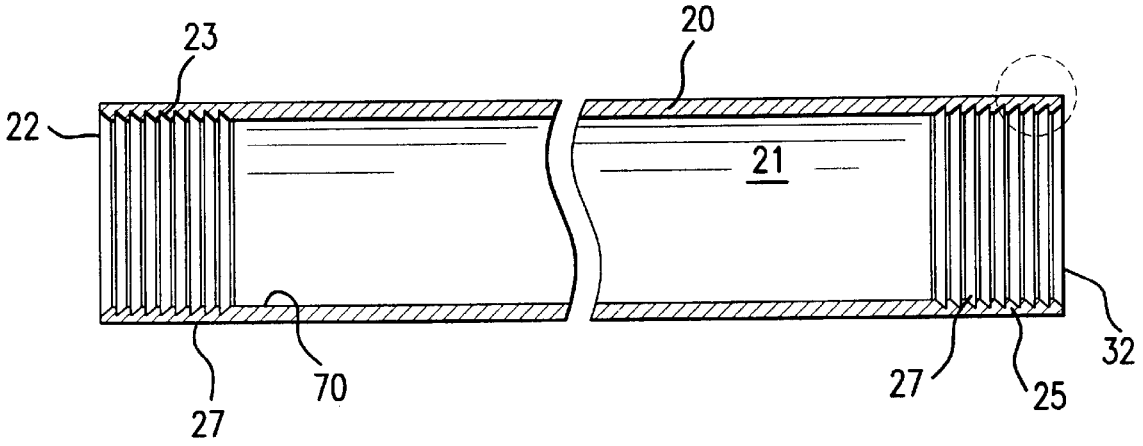
FIG. 2*a* is a cross-sectional side view of a hollow body of a bow stabilizer having peripheral grooves at or near each of a first opening and a second opening of the hollow body, according to one preferred embodiment of this invention.

At least a portion of hollow body 20 defines or forms a chamber 21, as shown in FIGS. 1 and 2*a*. Chamber 21 is at least partially filled with a fill 24 comprising at least one solid and/or at least one liquid. Suitable solids include, for example, sand, crushed stone, plastic particles, ceramic particles, metal particles and any other suitable material or other granular solids that transfer energy when the solids move against an internal wall or surface 70 of hollow body 20 and/or against each other. Preferably, suitable solids comprise particles of generally average size. The term average size as used throughout this specification and the claims means that the shapes and diameters of particles may vary, but that the individual particle shapes and diameters should not be grossly disproportionate to one another.

Suitable liquids include, for example, water, glycol solution, oil and hydraulic fluid. Preferably, any liquid within hollow body 20 should be able to withstand the climate in which bow stabilizer 15 is anticipated to be used. Fill 24 is preferably designed so that any change in a liquid viscosity as the temperature changes will not negatively affect the performance of bow stabilizer 15 according to this invention.

In one preferred embodiment of this invention, hollow body 20 comprises at least one first opening 22. Preferably, as shown in FIG. 2*a*, first opening 22 is formed at a proximal end portion 23 and a second opening 32 is formed at an opposing distal end portion 25 of hollow body 20. It is apparent to those having ordinary skill in the art that hollow body 20 may have only one opening, for example either at the proximal end portion 23 or the distal end portion 25.

Figure 3A:
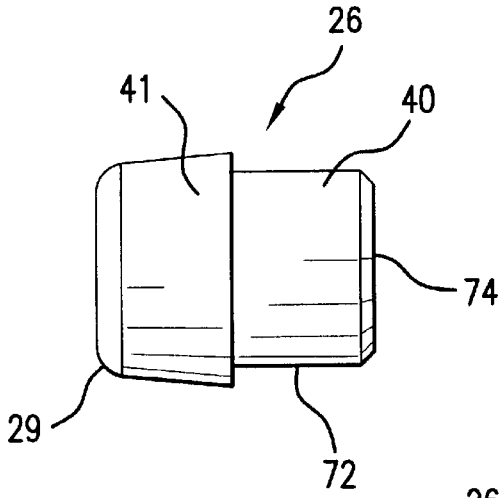
FIG. 3*a* is a side view of a plug, according to one preferred embodiment of this invention.
Figure 3B:
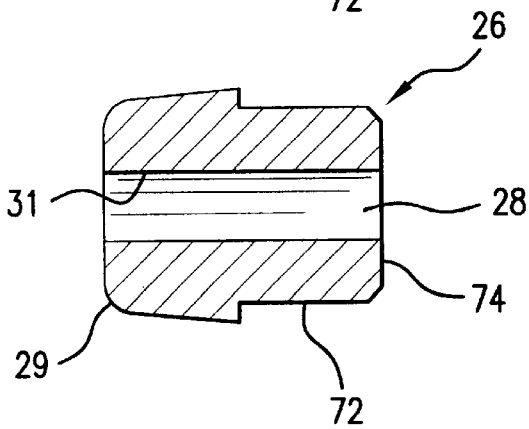
FIG. 3*b* is a cross-sectional side view of the plug such as shown in FIG. 3*a*, forming a bore, according to one preferred embodiment of this invention.

A first plug 26 is removably mountable or positionable within first opening 22. In one preferred embodiment of this invention, first plug 26 forms a bore 28, as shown in FIG. 3*b*. Preferably, bore 28 is formed along a longitudinal axis of first plug 26 so that when first plug 26 is positioned within first opening 22, bore 28 is coaxially aligned with a longitudinal chamber axis 12. The term longitudinal chamber axis refers to an axis parallel to a length of chamber 21, preferably but not necessarily equidistant from internal surface 70 of hollow body 20.

As shown in FIG. 1, at least a portion of first plug 26 has an outer surface 72 having a peripheral shape that corresponds to the peripheral shape of internal surface 70 of hollow body 20. The peripheral shape of outer surface 72 of first plug 26 in one manner corresponds to internal surface 70 by an area of outer surface 72 intimately contacting internal surface 70 and thereby forming a tight seal between first plug 26 and hollow body 20. First plug 26 may have a chamfered edge 29 to prevent any sharp edges.

Figure 2B:
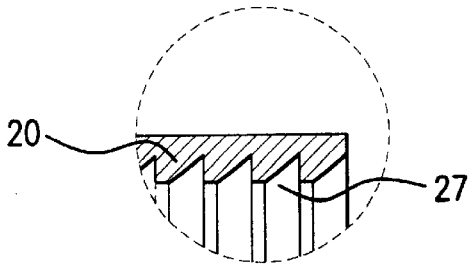
FIG. 2*b* is an enlarged view of a portion, as shown by the dashed circle in FIG. 2*b*, of an opening of a hollow body having a plurality of peripheral grooves, according to one preferred embodiment of this invention.

As shown in FIGS. 2*a* and 2*b*, preferably, but not necessarily, at least a portion of hollow body 20 has a plurality of peripheral grooves 27 at or near first opening 22 to enhance the seal between first plug 26 and internal surface 70. Peripheral grooves 27 may comprise conventional threads or any suitable projections and/or indentations that form an irregular or roughened surface. Similarly, at least a portion of first plug 26 may have peripheral grooves alone or corresponding to peripheral grooves 27 of hollow body 20.

A sealing means, for example a gasket or an O-ring may be positioned between hollow body 20 and first plug 26. Preferably, the gasket or O-ring is made of natural or synthetic rubber or polymeric material, or any other suitable material. The O-ring can be used to enhance the seal between first plug 26 and hollow body 20, to sealably contain fill 24 within chamber 21. In another preferred embodiment of this invention, the sealing means comprise a suitable adhesive material or layer between first plug 26 and hollow body 20. For example, an adhesive can be applied, such as in a coating or a layer form, to outer surface 72 and/or to internal surface 70.

First plug 26 is made of a resiliently deformable material. The term resiliently deformable material as used throughout this specification and in the claims means any suitable material having appropriate resilience and deformability so that first plug 26 is easily compressible and thus deformable when a compression force is applied to at least a portion of first plug 26 but returns to an initial shape when the compression force is removed. First plug 26 can be constructed of a natural or synthetic rubber material or another polymeric material, a composite material or any other suitable resiliently deformable material. Because it is resilient, first plug 26 is easily removable from within first opening 22.

Bow stabilizer 15 further comprises a means for enlarging an outer surface of first plug 26. In one preferred embodiment of this invention, bow stabilizer 15 comprises a sealing device 30 mounted with respect to first plug 26 and moveable between a first position and a second position. Outer surface 72 of first plug 26 in the second position is enlarged with respect to outer surface 72 of first plug 26 in the first position.

Figure 4A:
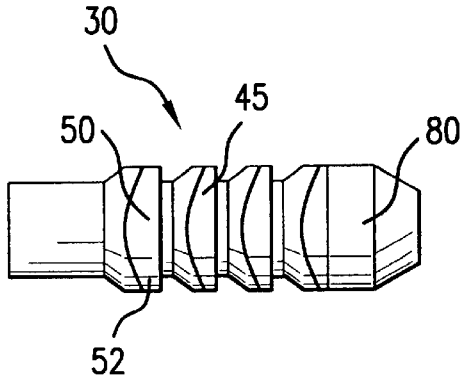
FIG. 4*a* is a side view of an insert, connected to an element, positionable within a plug, according to one preferred embodiment of this invention.
Figure 4B:
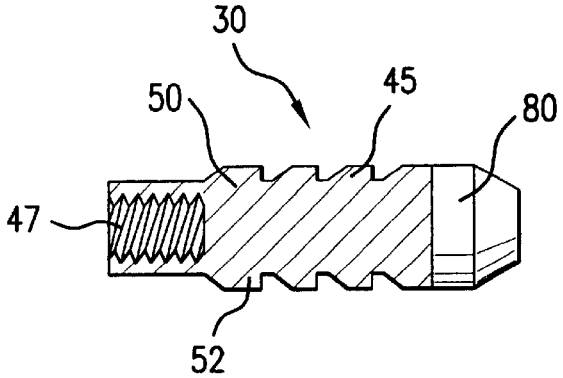
FIG. 4*b* is a cross-sectional side view of the insert such as shown in FIG. 4*a*, forming a second bore having internal threads, according to one preferred embodiment of this invention.

In one preferred embodiment of this invention, sealing device 30 comprises an insert 45, which is positionable within bore 28, as shown in FIG. 1. Insert 45 may be positioned within bore 28 using conventional means, for example press-fitting insert 45 into bore 28. Preferably, but not necessarily, insert 45 is made of a metal or metal alloy, such as steel or brass. Other suitable materials may be used to make insert 45. As shown in FIGS. 1, 4*a* and 4*b*, insert 45 comprises a shaft 50 which extends through bore 28 when insert 45 is positioned within first plug 26. Preferably, shaft 50 comprises a plurality of ribs or projections 52 which extend radially from a periphery of shaft 50 to interfere with a surface 31 of first plug 26 forming bore 28. Each projection 52 has a peripheral surface which contacts surface 31. Projections 52 ensure that insert 45 is securely positioned within bore 28 and that inner portion 40 of first plug 26 is enlarged so that outer surface 72 contacts internal surface 70 of hollow body 20 to tightly seal and contain fill 24 within chamber 21.

In one preferred embodiment of this invention as shown in FIG. 4*b*, shaft 50 forms a second bore 47 having a plurality of internal threads about an interior surface of shaft 50 forming second bore 47. A mounting stud 48 at a first end portion is threadedly engageable with the internal threads of shaft 50 and at a second end portion is threadedly engageable with a threaded female coupling of archery bow 10 to secure bow stabilizer 15 to archery bow 10.

As insert 45 is positioned within bore 28, inner portion 40 of first plug 26 positioned within hollow body 20 deforms. As inner portion 40 deforms, outer surface 72 of first plug 26 is enlarged and forced towards internal surface 70 of hollow body 20 to tightly close or seal first opening 22 and sealably contain fill 24 within chamber 21. An outer portion 41 of first plug 26 may or may not be deformed as insert 45 is positioned within bore 28.

Figure 5A:
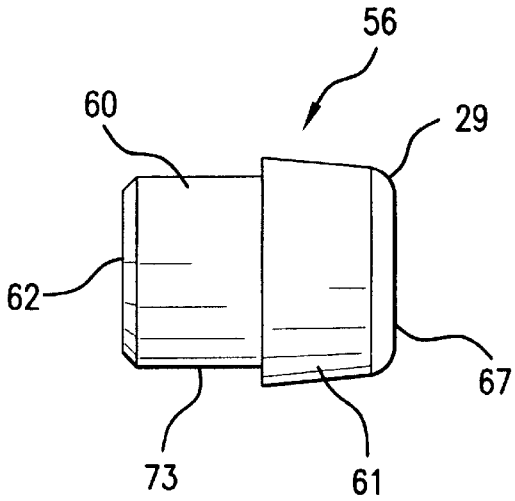
FIG. 5*a* is a side view of a plug, according to one preferred embodiment of this invention.
Figure 5B:
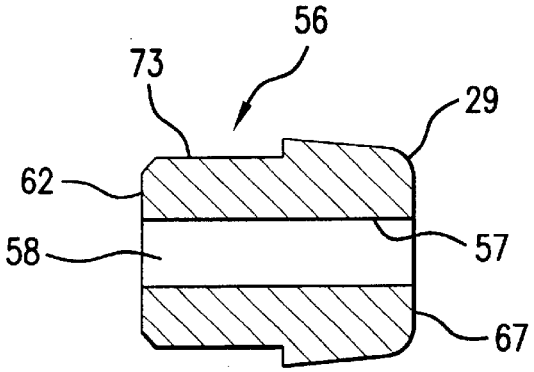
FIG. 5*b* is a cross-sectional side view of the plug such as shown in FIG. 5*a*, forming a bore, according to one preferred embodiment of this invention.

In one preferred embodiment of this invention, as shown in FIG. 2*a*, hollow body 20 comprises second opening 32 formed at distal end portion 25. At least a portion of a resiliently deformable second plug 56 is removably mountable or positionable within second opening 32 to at least partially close second opening 32. Preferably, but not necessarily, second plug 56 is the same or similar to first plug 26. At least a portion of second plug 56 has an outer surface 73 having a shape that corresponds to the shape of second opening 32. Second plug 56 may have chamfered edge 29 to prevent any sharp edges. In one preferred embodiment of this invention as shown in FIG. 5*b*, second plug 56 forms a bore 58 along a longitudinal axis of second plug 56 so that when second plug 56 is positioned within second opening 32, bore 58 is coaxially aligned with longitudinal chamber axis 12.

Preferably, but not necessarily, at least a portion of hollow body 20 has a plurality of peripheral grooves 27 at or near second opening 32 to tightly secure second plug 56 within second opening 32, as shown in FIGS. 2*a* and 2*b*. An O-ring may be positioned between hollow body 20 and second plug 56 to better contain fill 24 within chamber 21. Sealing device 30 is mounted with respect to second plug 56 wherein an inner portion 60 of second plug 56 is positioned within hollow body 20.

Figure 6A:
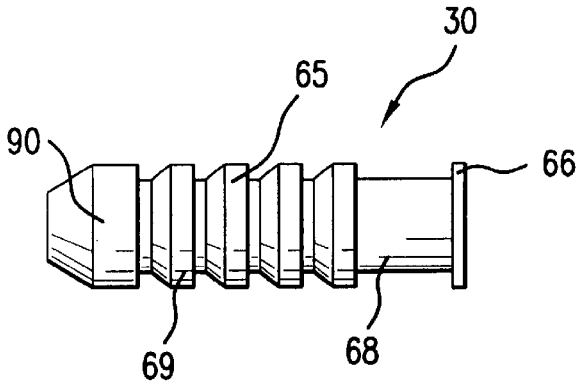
FIG. 6*a* is a side view of an insert, connected to an element, positionable within a plug, according to one preferred embodiment of this invention.
Figure 6B:
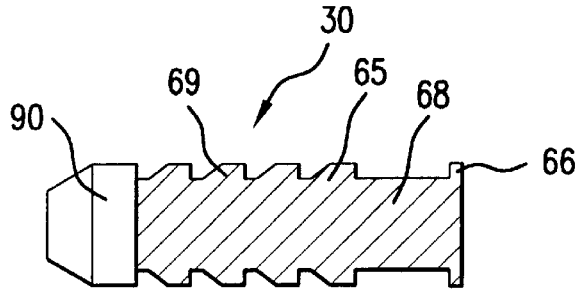
FIG. 6*b* is a cross-sectional side view of the insert such as shown in FIG. 6*a*, having a flange, according to one preferred embodiment of this invention.

In one preferred embodiment of this invention, sealing device 30 comprises an insert 65 which is positionable within bore 58, as shown in FIG. 1. Preferably, but not necessarily, insert 65 is made of a metal or metal alloy, such as brass or steel, and press-fitted into bore 58. Other suitable materials may be used to make insert 65 and other suitable means may be used to position insert 65 within second plug 56. In one preferred embodiment of this invention, insert 65 comprises a flange 66 about a periphery of insert 65 which radially interferes with at least a portion of an exterior surface 67 of second plug 56, as shown in FIGS. 1, 6*a* and 6*b*.

Insert 65 comprises a shaft 68 which extends through bore 58 when insert 65 is positioned within bore 58, as shown in FIG. 1. Preferably, shaft 68 comprises a plurality of ribs or projections 69 which extend radially from a periphery of shaft 68 to interfere with a surface 57 of second plug 56 forming bore 58. Each projection 69 has a peripheral surface which contacts surface 57. Projections 69 ensure that insert 65 is securely positioned within bore 58 and that inner portion 60 is enlarged so that outer surface 73 contacts internal surface 70 of hollow body 20 to tightly seal and contain fill 24 within chamber 21.

As insert 65 is positioned within bore 58, second plug 56 deforms and inner portion 60 enlarges so that outer surface 73 contacts or is forced towards internal surface 70 of hollow body 20, for example to tightly close or seal second opening 32 and sealably contain fill 24 within chamber 21. An outer portion 61 of second plug 56 may or may not deform as insert 65 is positioned within bore 58. Second plug 56 is easily removable from second opening 32 by removing insert 65, similar to removing first plug 26.

As shown in FIG. 1, insert 45 and insert 65 may be accessed from within chamber 21 and/or from an exterior of bow stabilizer 15. In one embodiment of this invention, a mounting stud 48 may be threadedly engageable with shaft 68 of insert 65, wherein one or more additional stabilizer elements, a wind direction indicator, or other known attachments, for example, may be attache d or fixed to bow stabilizer 15.

Figure 7A:
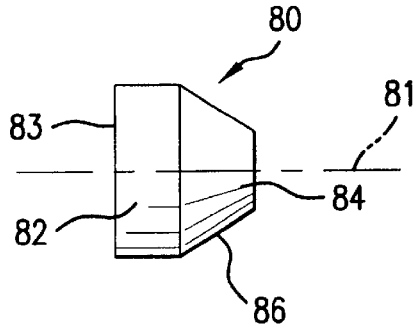
FIG. 7*a* is a side view of an element, for example an energy director, according to one preferred embodiment of this invention.
Figure 7B:
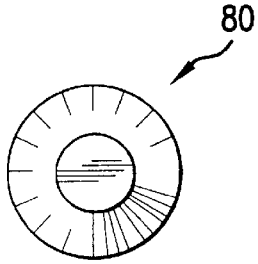
FIG. 7*b* is a front view of the element shown in FIG. 7*a*, according to one preferred embodiment of this invention.

In one preferred embodiment of this invention, an element 80, for example an energy director, extends from first plug 26 and at least a portion of element 80 is exposed within chamber 21. Element 80 has a longitudinal element axis 81 which is preferably coaxially aligned with longitudinal chamber axis 12. Element 80 is preferably made of a resiliently deformable material, for example a natural or synthetic rubber, another polymeric material or a composite material. As shown in FIG. 7*a*, element 80 has a fixed end portion 82 which contacts an inner wall or surface 74 of first plug 26 and a free end portion 84 at a distance from first plug 26. Preferably, but not necessarily, fixed end portion 82 has a circumference about equal to a circumference of each projection 52. In one preferred embodiment of this invention, the circumference of fixed end portion 82 and the circumference of each projection 52 is greater than a circumference of bore 28. Fixed end portion 82 comprises a distal wall or surface 83 which radially interferes with at least a portion of inner surface 74 to seal bore 28. Element 80 is attached or connected to shaft 50 of insert 45 and may be inserted with insert 45 through bore 28 and at least partially into chamber 21.

As shown in FIG. 1, at least a portion of element 80 converges in a direction from fixed end portion 82 to free end portion 84 along longitudinal chamber axis 12. Preferably but not necessarily, element 80 comprises an outer surface 86 having a generally conical shape. Outer surface 86 may have any shape suitable for altering or deflecting the direction of particle movement within chamber 21, as discussed below. A peripheral volume is defined within chamber 21 between outer surface 86 of element 80 and internal surface 70 of hollow body 20.

Figure 8A:
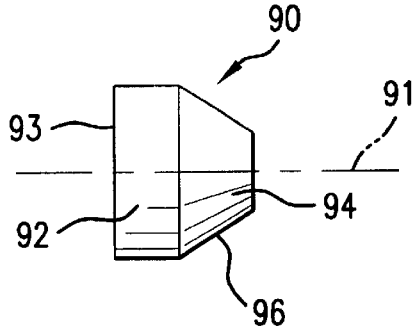
FIG. 8*a* is a side view of an element, for example an energy director, according to one preferred embodiment of this invention.
Figure 8B:
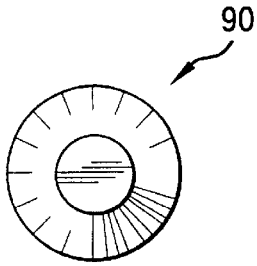
FIG. 8*b* is a front view of the element shown in FIG. 8*a*, according to one preferred embodiment of this invention.

Similarly, a second element 90 extends from second plug 56 and at least a portion of element 90 is exposed within chamber 21. Element 90 has a longitudinal element axis 91 which is coaxially aligned with longitudinal chamber axis 12. Preferably, element 90 is made of a resiliently deformable material, for example the same or similar to the material used to make element 80. As shown in FIG. 8*a*, element 90 has a fixed end portion 92 contacting an inner wall or surface 62 of second plug 56 and a free end portion 94 at a distance from second plug 56. Preferably but not necessarily, fixed end portion 92 has a circumference about equal to a circumference of each projection 69. In one preferred embodiment of this invention, the circumference of fixed end portion 92 and the circumference of each projection 69 is greater than a circumference of bore 58. Fixed end portion 92 comprises a distal wall or surface 93 which radially interferes with at least a portion of inner surface 62 to seal bore 58. Element 90 may be attached or connected to shaft 68 of insert 65 and inserted with insert 65 through bore 58 until it is at least partially exposed within chamber 21.

As shown in FIG. 1, at least a portion of element 90 converges in a direction from fixed end portion 92 to free end portion 94, along longitudinal chamber axis 12. Preferably but not necessarily, element 90 comprises an outer surface 96 having a generally conical shape. Outer surface 96 may have the same or similar shape as outer surface 86 of element 80 or a different shape suitable for altering or deflecting the direction of particle movement within chamber 21, as discussed below. A peripheral volume is defined within chamber 21 between outer surface 96 of element 90 and internal surface 70 of hollow body 20.

Figure 9:
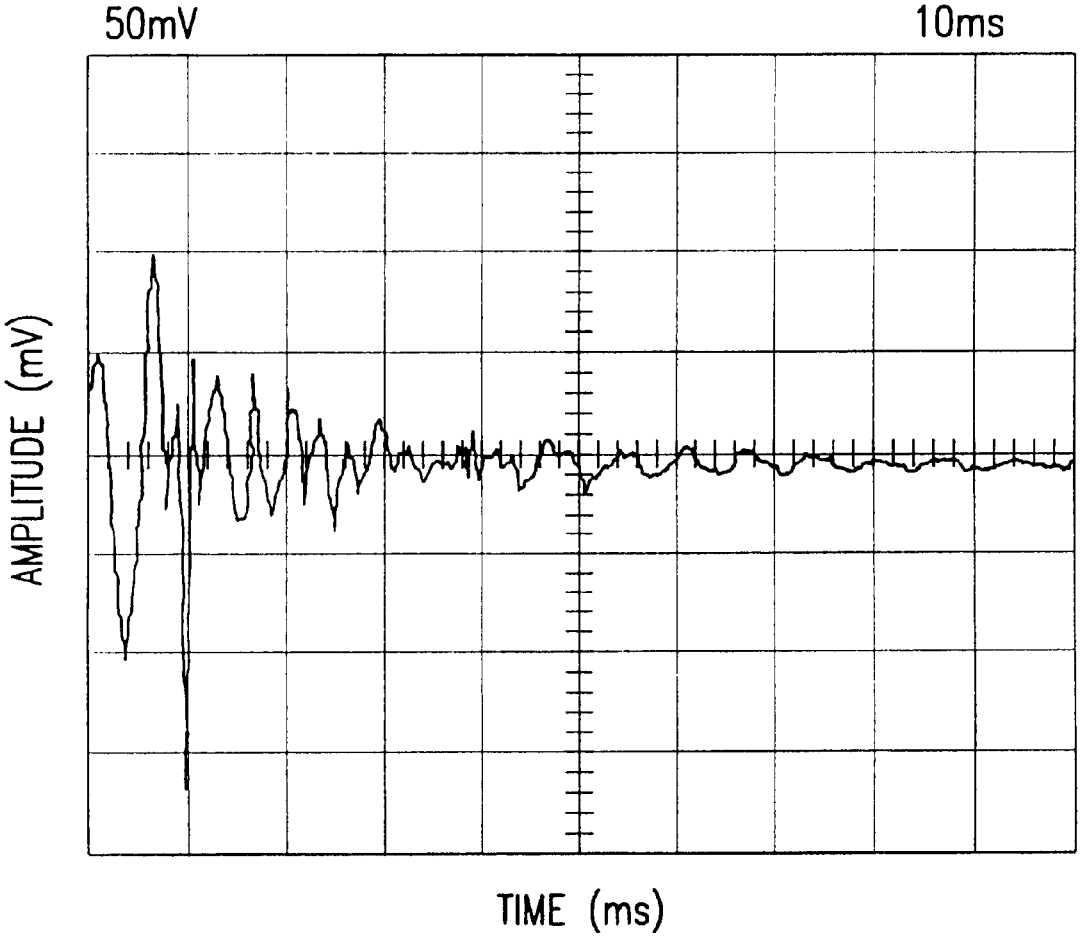
FIG. 9 is a graph of recoil vibration amplitude versus time for a conventional bow stabilizer after release of an archery arrow.

Referring to FIG. 9, when an archery arrow is released, an archery bow having a conventional bow stabilizer recoils into the archer's hand. A fill within a chamber of the conventional bow stabilizer initially remains relatively stationary and generally dispersed within the chamber before the archery arrow is released. During a first recoil of the archery bow, the conventional bow stabilizer moves along with the recoiling archery bow. The fill particles move in a direction towards a distal end portion of the chamber and generally collect at the distal end portion of the chamber after colliding with an interior wall positioned at the distal end portion. When an opposite second recoil occurs, the archery bow reacts and moves away from the archer's hand. Thus, the fill particles move in a direction towards a proximal end portion of the conventional bow stabilizer and generally collect there after colliding with an interior wall positioned at the proximal end portion.

This cycle of recoils, or action and reaction, continues for several milliseconds until the archery bow comes to a rest. The cycle of recoils generally exhibits a hyperbolic sinusoid, as shown in FIG. 9. The impact of the fill particles against the interior walls of the conventional bow stabilizer, particularly when the fill is not evenly disbursed with the chamber, contributes to a recoil vibration having an increased amplitude.

In accordance with this invention, bow stabilizer 15 having elements 80 and/or 90 exposed within chamber 21, decreases the amplitude of the recoil vibration after release of an archery arrow. Elements 80 and 90, preferably having conical outer surfaces 86 and 96 respectively, each has a longitudinal element axis which is coaxially aligned with longitudinal chamber axis 12. Thus, with elements 80 and 90 centrally disposed within chamber 21, fill particles impact each element 80 and 90 and the direction of the relative movement of at least a portion of the fill particles is altered or deflected in a generally outward radial direction, i.e. towards internal surface 70 of hollow body 20. As a result of this directional alteration or deflection of movement, more particle-particle collisions occur. These particle-particle or intraparticle collisions disrupt the general movement of fill 24 toward inner surface 74 of first plug 26, for example.

During a first recoil, the fill particles generally disposed throughout chamber 21 will move, for example in a direction towards distal end portion 25. It is apparent to those having ordinary skill in the art that the fill particles may initially move in any predetermined direction, depending on the design configuration of chamber 21. At least a portion of the fill particles will collide with outer surface 86 of element 80 and be deflected in a generally outward radial direction towards internal surface 70 of hollow body 20. As the deflected fill particles move in the radial direction, the occurrence of particle-particle collisions will increase. Thus, less fill particles will collide with inner surface 74 of first plug 26 and collect at distal end portion 25.

Figure 10:
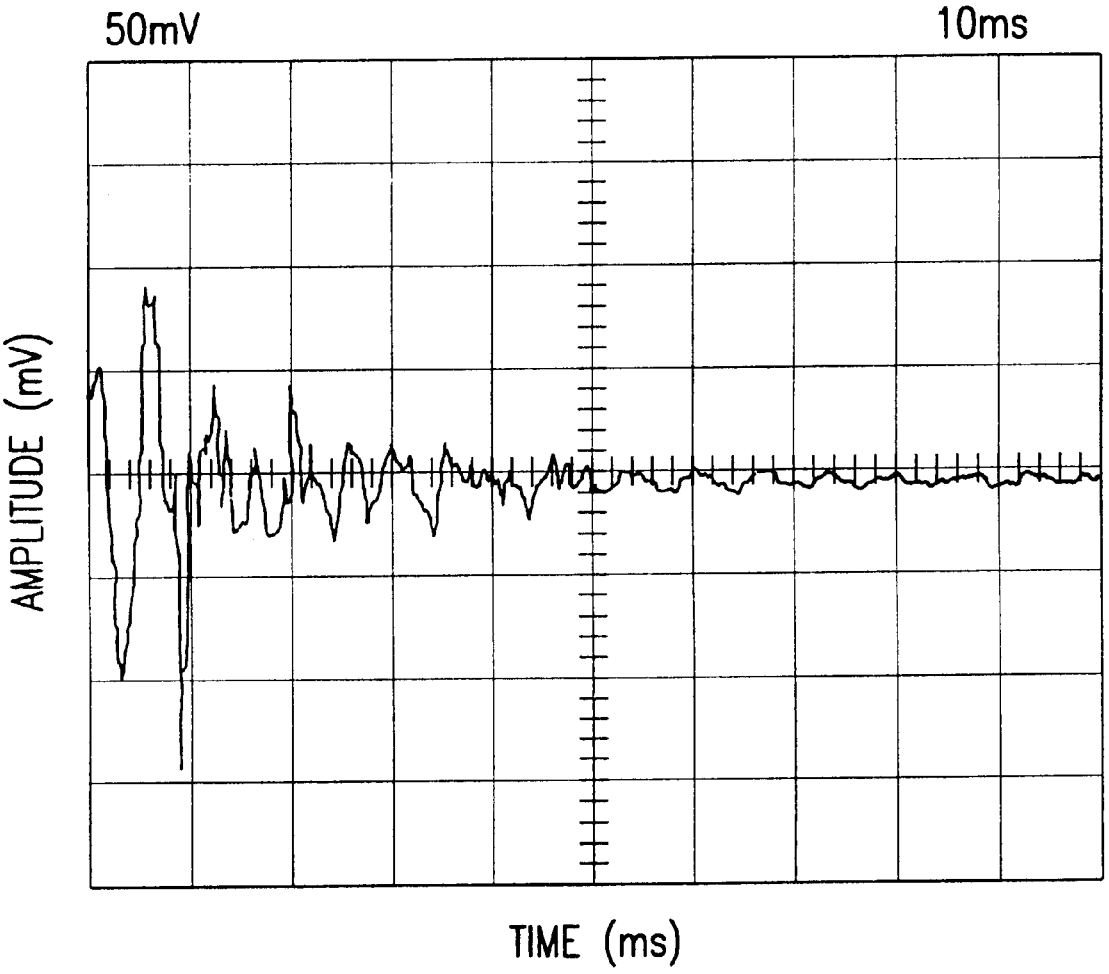
FIG. 10 is a graph of recoil vibration amplitude versus time for a bow stabilizer after release of an archery arrow, the bow stabilizer having at least one element, for example an energy director, exposed within a chamber of the bow stabilizer, according to one preferred embodiment of this invention.

During an opposite second recoil, the fill particles will generally move in a direction towards proximal end portion 23 of hollow body 20. At least a portion of the fill particles will collide with outer surface 96 of element 90 and be deflected in a generally outward radial direction towards internal surface 70, resulting in an increase in particle-particle collisions during the second recoil. Thus, less fill particles will collide with inner surface 62 of second plug 56 during the second recoil. As shown in FIG. 10, the vibration amplitude during the recoil cycle is decreased with bow stabilizer 15, in accordance with this invention, when compared to the vibration amplitude during the recoil cycle of a conventional bow stabilizer.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

We claim:

1. In a bow stabilizer for an archery bow, the bow stabilizer having a hollow body forming a chamber, the hollow body having at least one opening, and a plug closing at least a portion of the at least one opening, the improvement comprising:

an element extending from the plug, the element having a fixed end portion contacting the plug and a free end portion positioned at a distance from the plug, the element exposed within the chamber, and at least a portion of the element converging in a direction from the fixed end portion to the free end portion, wherein a distal surface of the element radially interferes with an inner surface of the plug.

2. In the bow stabilizer according to claim 1 wherein the element comprises a longitudinal element axis which is coaxially aligned with a longitudinal chamber axis of the chamber.

3. In the bow stabilizer according to claim 1 wherein the element is of a resiliently deformable material.

4. In the bow stabilizer according to claim 1 wherein at least a portion of the element has a conical shape.

5. In the bow stabilizer according to claim 1 wherein a peripheral volume is defined between an exterior surface of the element and an internal surface of the hollow body.

6. In the bow stabilizer according to claim 1 wherein the element is attached to an insert extending through a bore formed by the plug.

7. In the bow stabilizer according to claim 6 wherein the insert comprises a shaft having a plurality of radially extending projections which interfere with a surface of the plug forming the bore.

8. In the bow stabilizer according to claim 7 wherein each of the radially extending projections has a circumference greater than a circumference of the bore.

9. In the bow stabilizer according to claim 8 wherein a circumference of the element is about equal to the circumference of each radially extending projection.

10. In the bow stabilizer according to claim 1 wherein an outer surface of the plug has a first shape that corresponds to a second shape of the at least one opening.

11. In the bow stabilizer according to claim 1 wherein the plug is of a resiliently deformable material.

12. In the bow stabilizer according to claim 1 wherein a sealing device comprises an insert extending through a bore formed by the plug.

13. In the bow stabilizer according to claim 12 wherein the insert is press-fitted within the plug.

14. In the bow stabilizer according to claim 1 further comprising a second plug which at least partially closes a second opening in the hollow body.

15. In the bow stabilizer of claim 14 wherein an insert is positioned within a bore formed by the second plug to contain a fill within the chamber.

16. In a bow stabilizer for an archery bow, the bow stabilizer having a hollow body forming a chamber, the chamber defining a longitudinal chamber axis and at least partially filled with at least one of a solid and a liquid, the hollow body having a first opening formed at a proximal end portion and a second opening formed at a distal end portion, a first plug mounted within the first opening and a second plug mounted within the second opening, the improvement comprising:

the first plug forming a first bore, a first insert positioned within the first bore, a first energy director connected to the first insert, at least a portion of the first energy director exposed within the chamber, the second plug forming a second bore, a second insert positioned within the second bore, a second energy director connected to the second insert, at least a portion of the second energy director exposed within the chamber.

17. In the bow stabilizer according to claim 16 wherein the first energy director comprises a first longitudinal element axis coaxially aligned with the longitudinal chamber axis.

18. In the bow stabilizer according to claim 16 wherein the second energy director comprises a second longitudinal element axis coaxially aligned with the longitudinal chamber axis.

19. In the bow stabilizer according to claim 16 wherein the first insert deforms at least a portion of the first plug and the second insert deforms at least a portion of the second plug to seal the chamber.

20. In the bow stabilizer according to claim 16 wherein the first insert further comprises a second bore, in an area about the second bore the first insert having a plurality of internal threads for threaded engagement with a first end portion of a mounting stud.

21. In the bow stabilizer according to claim 16 wherein a second end portion of the mounting stud is threadedly engageable with a threaded female coupling of the archery bow.

22. In the bow stabilizer according to claim 16 wherein the second insert further comprises a flange which radially interferes with an exterior surface of the second plug.

23. In the bow stabilizer according to claim 16 wherein at least one of the first element and the second element comprise an outer surface having a conical shape.

24. A bow stabilizer for an archery bow, the bow stabilizer comprising:

a hollow body forming a chamber, the hollow body having at least one opening;

a resiliently deformable plug, at least a portion of the plug positionable within the at least one opening and forming a bore;

an insert press-fitted within the bore formed by the plug; and an element connected to the insert, the element having a fixed end portion contacting the plug and a free end portion positioned at a distance from the plug, the element at least partially exposed within the chamber, and at least a portion of the element converging in a direction from the fixed end portion to the free end portion.

25. In the bow stabilizer according to claim 24 wherein the element is coaxially aligned with a longitudinal chamber axis.

26. In a bow stabilizer for an archery bow, the bow stabilizer having a hollow body forming a chamber, the hollow body having at least one opening, and a plug closing at least a portion of the at least one opening, the improvement comprising:

an element extending from the plug, the element having a fixed end portion contacting the plug and a free end portion positioned at a distance from the plug, the element exposed within the chamber, and at least a portion of the element converging in a direction from the fixed end portion to the free end portion, wherein the element is attached to an insert extending through a bore formed by the plug.

27. In a bow stabilizer for an archery bow, the bow stabilizer having a hollow body forming a chamber, the hollow body having at least one opening, and a plug closing at least a portion of the at least one opening, the improvement comprising:

an element extending from the plug, the element having a fixed end portion contacting the plug and a free end portion positioned at a distance from the plug, the element exposed within the chamber, and at least a portion of the element converging in a direction from the fixed end portion to the free end portion, wherein the element is attached to an insert comprising a shaft having a plurality of radially extending projections which interfere with a surface of the plug forming the bore.

28. In a bow stabilizer for an archery bow, the bow stabilizer having a hollow body forming a chamber, the hollow body having at least one opening, and a plug closing at least a portion of the at least one opening, the improvement comprising:

an element extending from the plug, the element having a fixed end portion contacting the plug and a free end portion positioned at a distance from the plug, the element exposed within the chamber, and at least a portion of the element converging in a direction from the fixed end portion to the free end portion; and a second plug which at least partially closes a second opening in the hollow body wherein an insert is positioned within a bore formed by the second plug to contain a fill within the chamber.

* * * * *